United States Patent [19]

Carithers, Jr.

[11] Patent Number: 4,505,174

[45] Date of Patent: Mar. 19, 1985

[54] AUTOMATIC MAT CUTTING APPARATUS

[76] Inventor: Charles H. Carithers, Jr., 1520 Edgewood St., Clinton, Miss. 39056

[21] Appl. No.: 547,953

[22] Filed: Nov. 2, 1983

[51] Int. Cl.[3] ..... B26F 1/38; B26D 3/00

[52] U.S. Cl. ..... 83/455; 83/71; 83/513; 83/555; 83/560; 83/614

[58] Field of Search ..... 83/519, 555, 614, 513, 83/455, 71, 560

[56] References Cited

U.S. PATENT DOCUMENTS 4,098,160 7/1978 Weil ..... 83/614 X 4,249,437 2/1981 Hagenson ..... 83/364 X

*Primary Examiner*—James M. Meister

[57] ABSTRACT

An automatic mat cutting apparatus for simultaneously cutting a rectangular opening in a rectangular mat is disclosed. The mat cutting apparatus includes four mat cutters which are cooperatively mounted and moved to cut the rectangular opening. A control device controls the movement of the mat cutters. The size of the opening which is cut in the mat is adjustable by adjusting the mountings for the mat cutters relative to each other. Two mats having slightly different sized openings are easily cut by an easy adjustment of the mat cutters relative to the respective mountings.

16 Claims, 8 Drawing Figures

AUTOMATIC MAT CUTTING APPARATUS

FIELD OF THE INVENTION

The present invention relates generally to the cutting of an opening of a mat, and more particularly to an automatic device for cutting a rectangular opening in a mat in one operation.

BACKGROUND OF THE INVENTION

It is frequently desired when mounting a picture or the like in a frame to provide a mat around the picture between the picture and the frame. Alternatively, a mat can be used as a picture frame. In either case, it is necessary to provide an opening in the mat through the picture can be seen. This is frequently done by hand and is a time consuming and somewhat imprecise method.

Automatic mat cutters have been provided in the prior art which use a die to cut a rectangular opening in a mat. However, the edges of the die cut mat must necessarily be at 90° to the mat whereas it is usually desired to provide a bevel, usually 45°, cut in the opening away from the picture to further enhance the appearance of the mat.

In order to cut a 45° angle automatically, prior art devices have been disclosed which could cut a straight beveled cut in a mat. However, except for a square opening, the length of cut had to be continually adjusted or a plurality of machines used to produce a large number of mats in a reasonable period of time.

A number of manually operated mat cutters have also been disclosed in the prior art. Typically, these mat cutters include a guide beneath which the mat to be cut is precisely located. A cutting blade is then mounted for reciprocation along the guide to cut the mat at the desired location. Stops are provided along the guides to precisely limit the length of cut. Devices of this type are disclosed in U.S. Pat. No. 4,038,751 (Albright), No. 3,463,041 (Shapiro et al), and No. 3,527,131 (Ellerin et al).

SUMMARY OF THE INVENTION

In accordance with the present invention, an automatic mat cutting apparatus for simultaneously cutting a rectangular opening in a rectangular mat is provided. The mat is considered as having mutually perpendicular X and Y reference axes which bisect the opening. The opening itself is defined by peripheral lines X1, X2, Y1, and Y2. These line designations are used to indicate that lines X1 and X2 are parallel to the X axis and lines Y1 and Y2 are parallel to the Y axis. The automatic mat cutting apparatus includes a planar base on which the mat rests. The mat is positioned relative to the planar base by guide means designated as X0 guide means and Y0 guide means which define lines parallel to the respective X and Y axes. Two outer sides of the mat are positioned relative to the guide means. In order to cut the peripheral lines of the opening, X1, X2, Y1, and Y2 mat cutters are, respectively, used. These mat cutters are respectively mounted by X1, X2, Y1, and Y2 cutter mounting means for movement along the respective lines. Appropriate moving means are provided to reciprocally move the mat cutters. Finally, a control means is provided to control the actuation of the moving means and to prevent the mat cutters from contacting an adjacent cutter during operation. The control means also controls the travel of the cutter so that a desired length of cut is made and so that the cuts intersect one another to produce the opening.

In the preferred embodiment of the present invention, the X1 and X2 mounting means are movable along the Y axis relative to one another and the Y1 and Y2 mounting means are movable along the X axis relative to one another. In this manner, the size of the opening cut in the mat is easily adjusted. A preferred means for achieving this adjustment of the size of the opening in the mat is to have the X1 mounting means immobile with respect to the X and Y axes. The other three mounting means are then adjustable relative to this stationery X1 mounting means. The X0 and Y0 guide means are also adjustable relative to the X1 mounting means to center the opening in the mat as well. Conveniently, the adjustments for the mounting means and guide means are provided in increments that correspond to standard mat sizes and mat size openings.

In the preferred embodiment, the mounting means include hold-down bars which are attached to one another and form a planar hold-down plate. This hold-down plate is pivoted relative to the base and a moving means is provided to raise the hold down-plate above the base. In this manner, the mat to be cut is easily inserted beneath the hold-down plate against the guide means. After the hold-down plate is lowered, the hold-down plate holds the mat in place as the cutting occurs. After the cutting is completed, the hold-down plate is then again raised to allow easy removal of the cut mat.

According to the preferred embodiment, the mat cutters include cutting blade edges which are selectively movable into and out of engagement with the mat. In this manner, the blades are moved into engagement with the mat prior to the cutting stroke, and are removed from the mat after the cut is made so that the mat cutter is returned to the starting position on the mounting means without further contact with the mat. The cutting blade edges are preferably disposed at an angle to the XY plane so that a beveled cut is produced in the mat.

The automatic mat cutting apparatus of the present invention can also be used to cut double mats. With double mats, a second mat is provided with a mat opening which is slightly larger than the mat opening of a first mat lying underneath the second mat. In order to cut the two different sized mat openings, the cutter mounting means each include a runner, and a slide adapted to move freely along the runner. An attaching means is then provided for attaching a respective mat cutter to the slide in one of two positions. In the first position, the mat cutter is located slightly inwardly toward the center of the mat from the second position so that the opening cut in the first position is slightly smaller than the opening cut in the second position.

It is an advantage of the present invention that a precisely centered and sized opening is easily and quickly cut in a mat using the apparatus of the present invention. In addition, a large number of similarly sized mats and openings can be cut quickly and efficiently.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
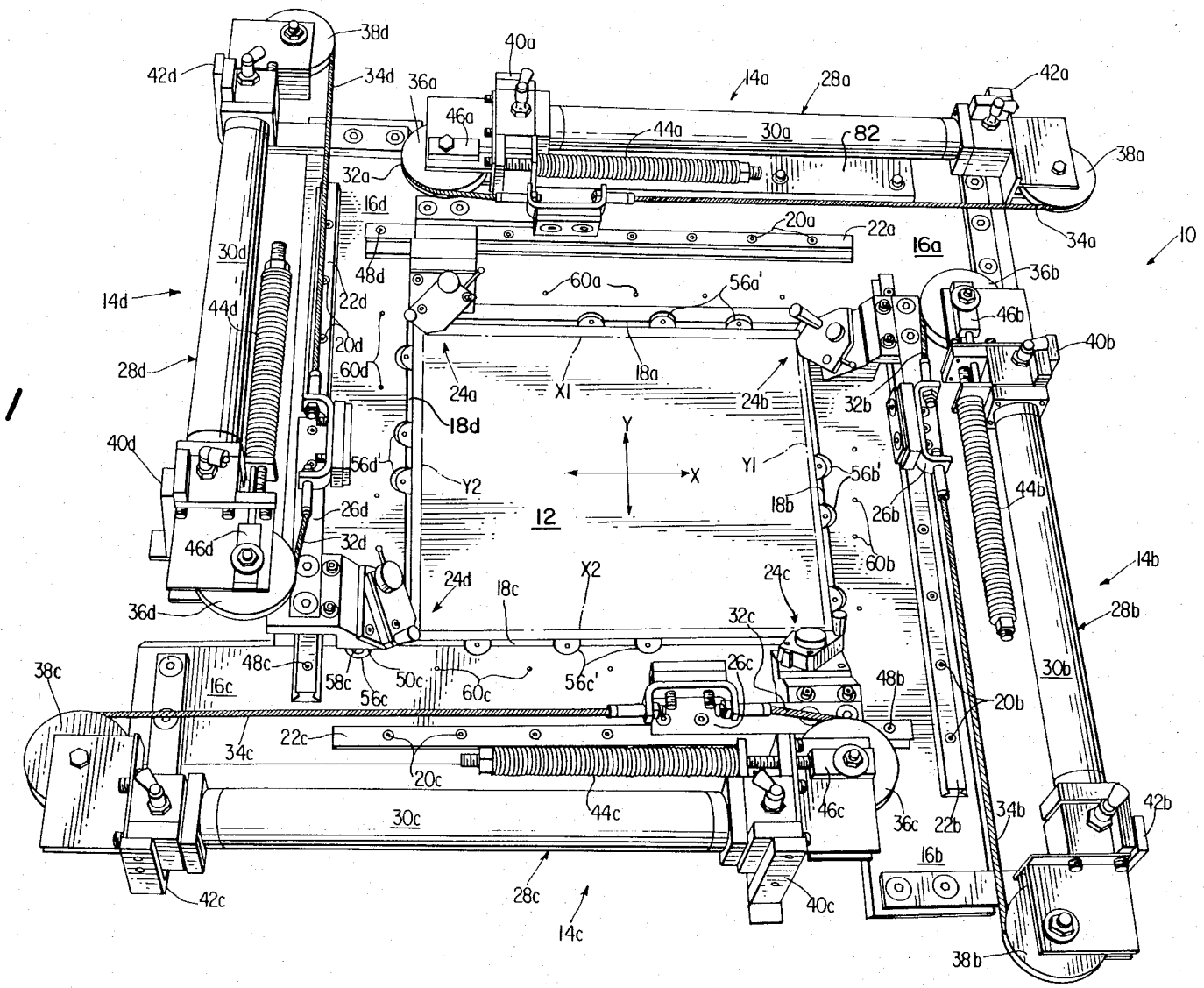
FIG. 1 is a schematic top perspective view of an automatic mat cutting apparatus according to the present invention with some elements removed for clarity.

With reference now to the drawings in which like numerals represent like elements throughout the several views, a presently preferred embodiment of an automatic mat cutter apparatus 10 resting on top of a mat 12 is depicted in FIG. 1. For reference purposes, mat 12 is considered as having X and Y axes as shown which bisect the rectangular opening to be made in the mat. The opening is schematically identified by peripheral lines X1, Y1, X2 and Y2. Lines X1 and X2 are parallel to the X axis and lines Y1 and Y2 are parallel to the Y axis.

Automatic mat cutting apparatus apparatus 10 includes four substantially identical cutting devices 14*a*, 14*b*, 14*c*, and 14*d*, which are associated with the cutting of respective lines X1, Y1, X2, and Y2. As cutting devices 14 are substantially identical, only cutting device 14*c* will be described in detail and the corresponding elements of the other cutting devices 14 will be identified using the same numerals followed by an "a", "b", or "d" suffix as appropriate.

Cutting device 14*c* includes a planar hold-down bar 16*c* having an inner edge 18*c* beveled at 45 degrees toward line X2. Securely attached to hold-down bar 16*c* by suitable screws 20*c* is a runner 22*c*. Slidably mounted on runner 22*c* is a mat cutter 24*c*. The mounting of mat cutter 24*c* on runner 22*c* is described in greater detail subsequently with reference to FIGS. 4 and 5.

Securely attached to mat cutter 24*c* is a bracket 26*c*. Attached to bracket 26*c* is a driving means 28*c*. Driving means 28*c* includes a pneumatic actuator 30*c*. Pneumatic actuator 30*c* is a double-acting pneumatic motor having a piston inside a cylinder with ropes 32*c* and 34*c* attached at each end of the piston. Ropes 32*c* and 34*c* run around respective pulleys 36*c* and 38*c* and are attached at their other ends to bracket 26*c*. Pneumatic actuator 30*c* is suitably attached to hold-down bar 16*c* by brackets 40*c* and 42*c*. The tension on ropes 32*c* and 34*c* is suitably controlled by a spring type tensioning means well known in the art including spring 44*c* and a slidable mounting 46*c* for pulley 36*c*.

Figure 3:
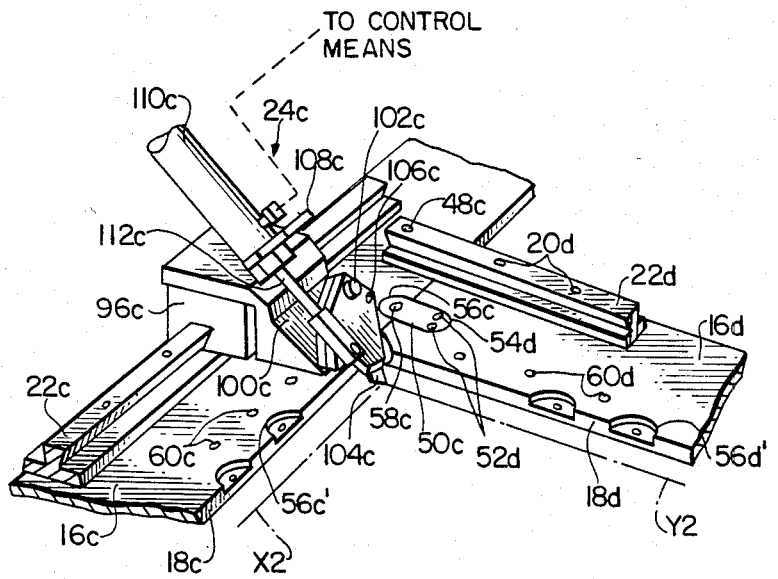
FIG. 3 is a schematic perspective view showing greater detail of a corner portion of the automatic mat cutting apparatus depicted in FIG. 1.

With additional reference to FIG. 3 in which mat cutter 24*c* is at the end of a cutting stroke, it can be seen that hold-down bar 16*c* is securely attached to hold-down bar 16*d*. This attachment is accomplished at two locations so that hold-down bar 16*c* is rigidly attached to hold-down bar 18*c*. The first point of attachment is accomplished with runner 22*d*. Runner 22*d* extends beyond hold-down bar 16*d* to a position above hold-down bar 16*c*. A suitable screw 48*d* passes through runner 22*d* and is received in hold-down bar 16*c* to securely attach runner 22*d* to hold-down bar 16*c*. In addition, hold-down bar 16*d* is attached to hold-down bar 16*c* by bridging connector 50*c*. As shown best in FIG. 3, bridging connector 50*c* is securely attached by screws 52*d* in a recess 54*d* provided in the end of hold-down bar 16*d*. Bridging connector 50*c* extends beyond the end of hold-down bar 16*d* and is received in a recess 56*c* provided in edge 18*c* of hold-down bar 16*c*. A screw 58*c* passes through bridging connector 50*c* and is received in hold-down bar 16*c* to securely attach bridging connector 50*c* to hold-down bar 16*c*. Conveniently, the end of hold-down bar 16*d* adjacent inner edge 18*c* of hold-down bar 16*c* is complimentarily beveled to inner edge 18*c* to provide a close fit between hold-down bars 16*c* and 16*d*.

As shown in FIGS. 1 and 3, hold-down bar 16*c* includes a plurality of recesses 56*c*′ which are substantially similar to recess 56*c*. In addition, a plurality of threaded holes 60*c* are provided along a length of hold down-bar 16*c*. Threaded holes 60*c* are adapted to receive the end of screw 48*c*. Thus, it can be appreciated that by the proper location of threaded holes 60*c* relative to recesses 56*c*′, hold-down bar 16*d* can be securely attached to hold down-bar 16*c* at a number of positions along the length of hold-down bar 16*c*. This is easily accomplished by removing screws 48*c* and 58*c* from hold-down bar 16*c*, and sliding hold down bar 16*c* along the end of hold-down bar 16*d* until bridging connector 50*c* again aligns with a new recess 56*c*′ and screw 48*c* is easily received in a new threaded hole 60*c*.

It should be appreciated that in a similar manner, hold-down bars 16*a*, 16*b*, 16*c*, and 16*d* can be relatively adjusted with respect to one another to change the size of the opening to be cut which is defined by lines X1, Y1, X2, and Y2. In the preferred embodiment of the present invention, hold-down bar 16*a* is actually immovable with respect to hold-down bars 16*b*, 16*c*, and 16*d*. Therefore, in order to adjust the size of the opening, all of the screws 48 and 58 must be removed. Hold-down bars 16*b* and 16*d* are then moved along the X and Y axes, respectively, to the desired location. Hold-down bars 16*b* and 16*d* are then attached to hold-down bar 16*a*. Finally, hold-down bar 16*c* is attached to hold-down bars 16*b* and 16*d*. Thus, it can be seen that the size of the opening is relatively adjusted by moving hold-down bars 16*b* and 16*d* along the X axis and the corresponding movement of hold-down bar 16*c* along the Y axis in relative to hold-down bar 16*a*.

Figure 2:
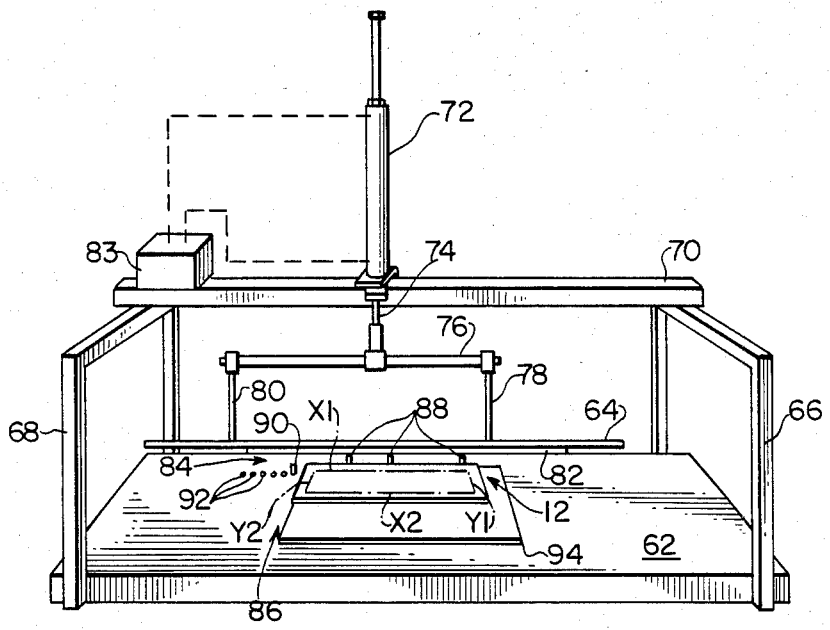
FIG. 2 is a front schematic view of the base of the automatic mat cutting apparatus depicted in FIG. 1.

Depicted in FIG. 2 is a base 62 of automatic mat cutting apparatus 10. The portion of automatic mat cutting apparatus 10 depicted in FIG. 1 is securely attached to base 62 but these elements have not been shown for the sake of clarity. Instead, only hold-down bars 16*a*, 16*b*, 16*c*, and 16*d* which are securely attached to one another and which form what will now be referred to as a hold-down plate 64 are shown. Base 62 includes uprights 66 and 68 across which a beam 70 is attached. Upstanding from beam 70 is a pneumatic actuator 72. Extending from pneumatic actuator 72 is a rod 74 which is attached to a cross rod 76. Cross rod 76 is attached at two places to shafts 78 and 80. Shafts 78 and 80 are securely attached to hold-down plate 64, preferably at an appropriate location on hold-down bar 16*c*. Hold-down plate 64 is also pivotally attached to base 62 at the rear thereof by a suitable hinge 82. Preferably, hinge 82 is attached to hold-down bar 16*a* as shown in FIG. 1. By actuation of pneumatic actuator 72, hold-down plate 64 is thus raised and lowered relative to base 62. Conventiently, a control means 83 controls the actuation of pneumatic actuator 72, as well as the other pneumatic actuators described previously and subsequently.

Located on the top of base 62 are X0 guide means 84 and Y0 guide means 86. X0 guide means 84 includes three studs 88 which are arranged in a straight line and extend above the surface of base 62. Y0 guide means 86 includes a single similar stud 90. As shown, stud 90 is located in one of a plurality of holes 92 in base 62 which extend parallel to X0 guide means 84. Thus, by appropriately locating stud 90 in a chosen hole 92, the position of Y0 guide means 86 relative to the Y axis is adjusted. Similar holes are provided for studs 88 of X0 guide means 94 so that the position of X0 guide means 84 is also easily adjusted relative to the X axis and along the length of Y0 guide means 86 as well.

Located on base 62 is a protective cover 94. Cover 94 is placed with one edge along studs 88 and the adjacent edge along stud 90. Conveniently, cover 94 is secured in place by tape or the like. Located on top of cover 94 is mat 12. Mat 12 is easily located beneath hold down plate 64 by sliding mat 12 along cover 94 until it contacts studs 88 and 90. It should be noted that studs 88 and 90 are located at a position relative to base 62 which assures that mat 12 is cut along lines X1, X2, Y1, and Y2 when hold down plate 64 is lowered by pneumatic actuator 72 on top of mat 12.

With reference again to FIG. 3, mat cutter **24*c* includes a slide 96*c* which is adapted to move freely along and be captured by runner 22*c*. Mounted on slide 96*c* and extending toward line X2 is a support 98*c*. Support 98*c* includes a face 100*c* which is at a 45° angle to hold-down plate 22*c*. Pivotally mounted to face 100*c* is a blade holder 102*c*. Blade holder 102*c* includes two plates which are secured together by a screw and between which a blade 104*c* extends outwardly and downwardly to line X2. Blade holder 102*c* is pivotally mounted about a pivot 106*c* to face 100*c***.

Also mounted to support **98*c* by a bracket 108*c* is a pneumatic actuator 110*c*. Pneumatic actuator 110*c* is suitably attached to blade holder 102*c* by a shaft 112*c*. Pneumatic actuator 110*c* is also controlled by control means 83 and is used to raise and lower blade 104*c*** relative to line X2.

Figure 4:
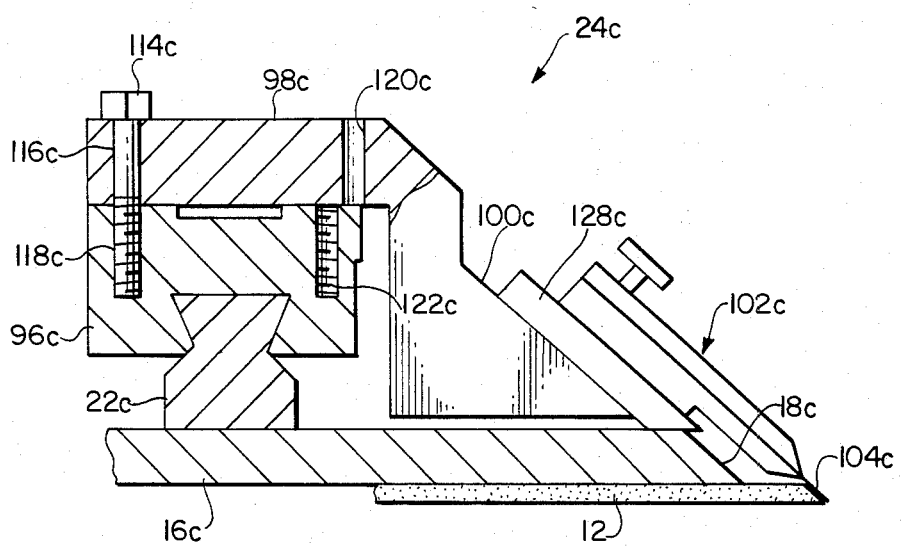
FIGS. 4 and 5 are schematic side elevation views of alternative mountings for mat cutters according to the present invention.
Figure 5:
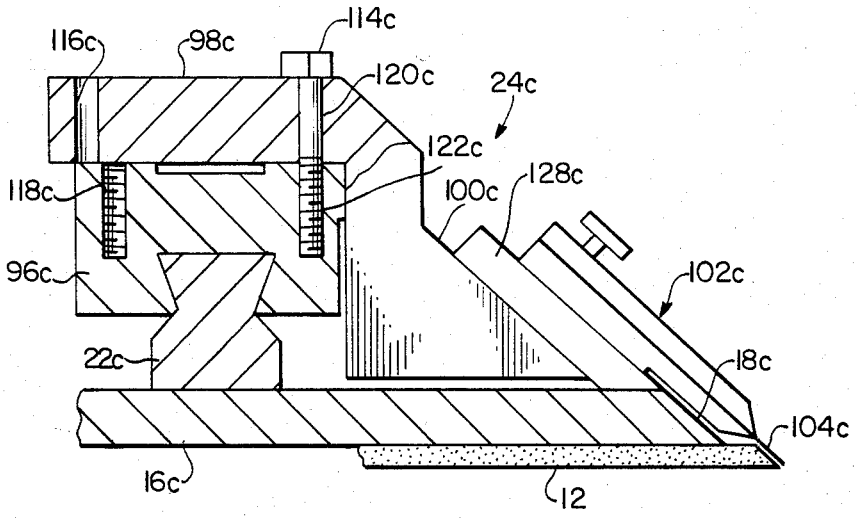
Figure 6:
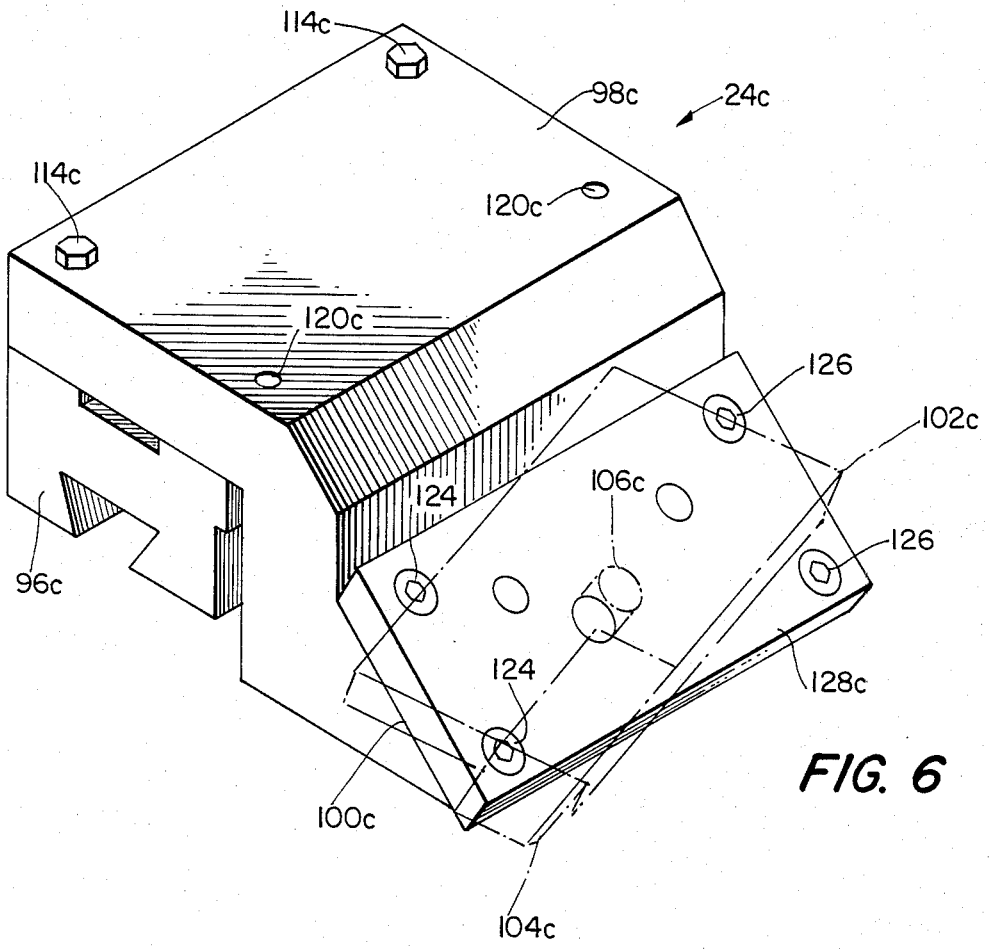
FIG. 6 is a schematic perspective view of the mounting for the mat cutter depicted in FIGS. 4 and 5.

Depicted in greater detail in FIGS. 4 and 5 is mat cutter **24*c*. Mat cutter 24*c* is shown with support 98*c* mounted to slide 96*c* in one position in FIG. 4 and in a second position in FIG. 5**.

In FIG. 4, support **98*c* is attached to slide 96*c* by a bolt 114*c* extending through a bore 116*c* in support 98*c*. Bolt 114*c* is received in a threaded bore 118*c*. Directly behind bolt 114*c* is a similarly disposed bolt so that support 98*c* is positively secured to 96*c*. In this position, it can be seen that blade 104*c* extends a moderate distance away from inner edge 18*c* of hold-down bar 16*c* when mat 12 is cut. It should also be noted that support 98*c* includes another bore 120*c* while slide 96*c* includes another threaded bore 122*c*. Bore 120*c* and threaded bore 122*c* do not align with one another when bolt 114*c* is received in threaded bore 118*c***.

In FIG. 5, bolt **114*c* has been removed from threaded bore 118*c* and support 98*c* shifted to the left to align bore 120*c* with threaded bore 122*c*. Bolt 114*c* is therefore received in threaded bore 122*c* in FIG. 5. In this position, it can be seen that blade 104*c* extends only a slight distance away from inner edge 18*c* of hold down bar 16*c*. Also not depicted as in FIG. 4 is a second bore and threaded bore immediately behind bore 120*c* and threaded bore 122*c* in which a similar bolt is received to secure support 98*c* to slide 96*c***.

In operation, automatic mat cutting apparatus 10 functions in the following manner. Initially, hold-down bars **16*a*, 16*b*, 16*c*, and 16*d* have been appropriately joined together to form a rigid hold-down plate 64 as depicted in FIG. 2. In addition, X0 guide means 84 and Y0 guide means 86 have been appropriately positioned so that when mat 12 is located along X0 guide means 84 and Y0 guide means 86 lines X1, Y1, X2, and Y2 are located at the positions where relative mat cutters 24*a*, 24*b*, 24*c*, and 24*d* cut an opening in mat 12. Control means 83** is then actuated by the operator.

Upon actuation of control means 83, pneumatic actuator 72 is first operated to lower hold-down plate 64 onto mat 12. This positively holds mat 12 in the desired location on base 62. Next, control means 83 causes pneumatic actuators 110 to move mat cutters 24 from the raised positions where blades 104 do not contact mat 12 to the lowered positions where blades 104 extend into mat 12. It should be noted that the initial starting positions of mat cutters 24 are depicted in FIG. 1. After blades 104 are in place in mat 12, control means 83 causes pneumatic actuators 30 to be operated. Pneumatic actuators 30 cause ropes 34 to pull mat cutters 24 along respective lines X1, Y1, X2, and Y2. This results in a precise cutting of an opening in mat 12. It should be noted that cutter **24*c* in FIG. 3** is depicted at the end of the cutting stroke.

After the cutting stroke, control means 83 causes pneumatic actuators 110 to raise blades 104 out of engagement with mat 12. After this is done, control means 83 causes pneumatic actuators 30 to return mat cutters 24 to the initial position depicted in FIG. 1. It should be appreciated by those of ordinary skill in the art that suitable stops and/or suitable switches are conveniently located along runners 22. These switches and/or stops are connected to control means 83 and precisely control the length of travel of mat cutters 24 to achieve a precise length of cut in mat 12. The use of suitable switches for a pneumatic actuator is disclosed in applicant's copending U.S. application Ser. No. 417,347 filed Oct. 19, 1982, now abandoned, which is herein incorporated by reference.

After lines X1, Y1, X2, and Y2 are cut in mat 12, pneumatic actuator 72 is actuated by control means 83 to raise hold-down plate 64 to the position shown in FIG. 2. Hold-down plate 64 pivots about hinge 82 as explained above. Once hold-down plate 64 is raised, the operator quickly and easily removes mat 12 and inserts a new mat 12 along X0 guide means 84 and Y0 guide means 86. Control means 83 is then actuated again to cut the new mat 12. In this manner, a large number of mats 12 can be provided with identical openings in a relatively short period of time.

Automatic mat cutting apparatus 10 is also particularly adapted for easily and quickly cutting both mats for a double mat set. Initially, the first mat is cut in the manner described above. Next, in order to cut the second mat, or a series of second mats, mat cutters 24 are moved from the position depicted in FIG. 4 to the position depicted in FIG. 5. This is accomplished for mat cutter **24*c* by removing the set of bolts 114*c* from the sets of bores 116*c* and threaded bores 118*c*. Support 98*c* is then shifted to the left as depicted in FIG. 4 to the position depicted in FIG. 5. When this occurs, the sets of bores 120*c* align with the sets of threaded bores 122*c* and bolts 114*c* are received therein. This shifting to the left of support 98***c* causes blade 104*c* to similarly shift to the left. This shifting moves the position of the cut line slightly to the left as well. The other mat cutters are similarly adjusted. After these adjustments, the mat opening is slightly larger than that previously provided and thus the second mat is suitable as an outer one of the double mat set. Obviously, the adjustments of supports 98 can also be used to provide slightly smaller or larger openings from a standard mat size which is defined by the other position of supports 98.

When it is desired to change the standard sized opening cut by automatic mat cutting apparatus 10, the following procedure is used. Initially, X0 guide means 84 and Y0 guide means 86 are adjusted as needed for a new overall sized mat and/or a new sized opening. This is to assure that the mat opening will be centered in mat 12. Next, screws 48*a*, 48*b*, 48*c*, and 48*d* are removed from respective runners 22*a*, 22*b*, 22*c*, and 22*d*. In addition, bridging connectors such as bridging connector 50*c* are disconnected by removing screws 58*c*. Once this is accomplished, hold-down bars 16*b*, 16*c*, and 16*d* are relatively movable with respect to hold-down bar 16*a* which is held stationary by hinge 82. Thus, it is a simple matter to move the bridging connector of hold-down bar 16*b* to the appropriate recess 56*a* in hold-down bar 16*a* for the new desired length of cut along line X1. In a similar manner, hold-down bars 16*c* and 16*d* are adjusted relative to respective hold-down bars 16*b* and 16*c*. It should be noted that hold-down bar 16*d* necessarily aligns with the bridging connector of hold-down bar 16*a*. Once this occurs, screws 48 are inserted in respective runners 22 and bridging connectors 50 are securely attached to respective hold-down bars 16. Thus, a newly configured and rigid hold-down plate 64 has been formed having a new opening defining a new position for lines X1, Y1, X2, and Y2. The location of the stops and/or switches are also adjusted as necessary. The operation of automatic mat cutting apparatus 10 then proceeds as described above.

Figure 7:
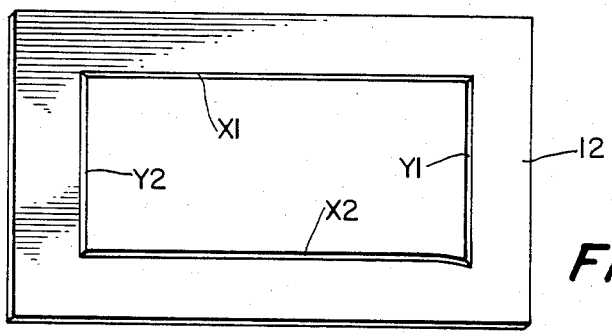
FIGS. 7 and 8 are schematic perspective views of cut mats having bowed starting cut lines.
Figure 8:
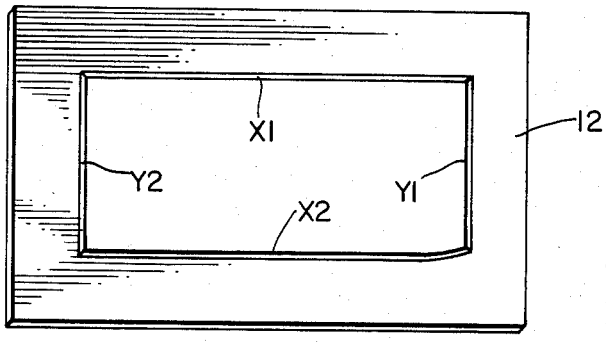

When using a mat cutter such as mat cutter 24*c*, there is sometimes a tendency for blade 104*c* to drift slightly outwards or inwards of the desired line X2 of cut near one end of the cut as depicted in FIGS. 7 and 8. In order to counter this tendency, it is possible to tighten adjustment screws 124 or 126. Adjustment screws 124 and 126 hold bronze plate 128*c* onto face 100*c* with blade holder 102*c* pivotally attached to plate 128*c*. Thus, where line X2 is bowed outwardly as depicted in FIG. 7, screws 124 are tightened. Screws 126 are tightened when line X2 is bowed inwardly as depicted in FIG. 8. With these adjustments, a straight cut along line X2 is achieved.

Although the present invention has been described with respect to an exemplary embodiment thereof, it will be understood by those of ordinary skill in the art that variations and modifications can be effected within the scope and spirit of the invention.

I claim:

1. An automatic mat cutting apparatus for simultaneously cutting a rectangular opening in a rectangular mat, the mat having mutually perpendicular X and Y reference axes which bisect the opening, the opening being defined by peripheral lines X1, X2, Y1, and Y2 with lines X1 and X2 parallel to the X axis and with lines Y1 and Y2 parallel to the Y axis, said mat cutting apparatus comprising:

a planar base upon which the mat rests;

an X0 guide means for positioning one outer side of the mat relative to said base, said X0 guide means defining a line parallel to the X axis and raised above said base and upon which one outer side of the mat rests;

a Y0 guide means for positioning an adjacent outer side of the mat relative to said base, said Y0 guide means defining a line parallel to the Y axis and raised above said base and upon which the adjacent side of the mat rests, the lines of said X0 and Y0 guide means having adjacent ends forming a corner;

X1, X2, Y1, and Y2 mat cutters;

X1, X2, Y1, and Y2 cutter mounting means for mounting respective X1, X2, Y1, and Y2 mat cutters for movement along respective lines X1, X2, Y1, and Y2 and above said base;

X1, X2, Y1, and Y2 cutter moving means for reciprocally moving respective said X1, X2, Y1, and Y2 cutters along respective said X1, X2, Y1, and Y2 mounting means; and a control means for controlling the actuation of said X1, X2, Y1, and Y2 moving means so as to prevent said X1, X2, Y1, and Y2 cutters from contacting an adjacent cutter and for controlling the travel of said X1, X2, Y1, and Y2 cutters so that a desired length of cut is made along each line X1, X2, Y1, and Y2 by respective said X1, X2, Y1 and Y2 cutters and so that the adjacent ends of the cuts intersect one another.

2. An automatic mat cutting apparatus as claimed in claim 1 wherein said X1 and X2 mounting means are movable along the Y axis relative to one another, and wherein said Y1 and Y2 mounting means are movable along the X axis relative to one another so that the size of the opening cut in the mat is adjustable.

3. An automatic mat cutting apparatus as claimed in claim 1 wherein said X1 mounting means is immovable with respect to the X and Y axes; and further including a Y1 adjusting means for adjusting said Y1 mounting means only along the X axis relative to said X1 mounting means, a X2 adjusting means for adjusting said X2 mounting means only along the Y axis relative to said Y1 mounting means, and a Y2 adjusting means for adjusting said Y2 mounting means only along the X axis relative to said X2 mounting means whereby the cooperative adjustments of said Y1, X2, and Y2 adjusting means changes the size of the opening cut by said X1, X2, Y1, and Y2 cutters.

4. An automatic mat cutting apparatus as claimed in claim 3 and further including an X0 adjusting means for adjusting said X0 guide means only along the Y axis relative to said base and a Y0 adjusting means for adjusting said Y0 guide means only along the X axis relative to said base whereby the centering of the opening in the mat is easily achieved after a change of the size of the opening with said Y1, X2, and Y2 adjusting means by a cooperative adjustment of the location of said X0 and Y0 guide means using said X0 and Y0 adjusting means.

5. An automatic mat cutting apparatus as claimed in claim 4 wherein said Y1, X2, and Y2 adjusting means are adjustable in increments corresponding to standard sized openings, and wherein said X0 and Y0 adjusting means are also adjustable in increments which correspond to the centering of the standard mat openings in standard size mats.

6. An automatic mat cutting apparatus as claimed in claim 5 wherein said X1, X2, Y1, and Y2 cutter mounting means include respective X1, X2, Y1, and Y2 flat hold-down bars; and wherein said X2, Y1, and Y2 adjusting means releasably attach said X1, X2, Y1, and Y2 hold-down bars together to form a planar hold-down plate.

7. An automatic mat cutting apparatus as claimed in claim 6 and further including a pivot means for pivotally mounting said X1 hold-down bar relative to said base about an axis parallel to the X axis; and a pivot moving means for pivoting said hold-down plate relative to said base about said pivot means between a raised position and a lowered position whereby in a raised position the mat is easily inserted and withdrawn from said X0 and Y0 guide means beneath said hold-down plate and in a lowered position the mat is positively held in place relative to said base by said hold-down plate.

8. An automatic mat cutting apparatus as claimed in claim 7 wherein said control means futher controls the actuation of said pivot moving means such that said hold-down plate is in the lowered position prior to actuation of said cutter moving means to cut the mat and is in the raised position after the cut is completed.

9. An automatic mat cutting apparatus as claimed in claim 1 wherein said X1, X2, Y1, and Y2 mat cutters include respective X1, X2, Y1, and Y2 cutting blade edges; further including X1, X2, Y1, and Y2 blade edge moving means for reciprocally moving respective said X1, X2, Y1, and Y2 blade edges between a down position wherein said blade edges extend down through the mat and an up position wherein said blade edges are located above the mat; and wherein said control means further controls respective said blade edge moving means so as to insert respective said blade edges into the mat prior to movement of respective said mat cutters from starting positions by respective said cutter moving means and to withdraw respective said blade edges after the desired movement of respective said mat cutters and the desired length of cuts are achieved and before respective said mat cutters are returned to the starting position by respective said cutter moving means.

10. An automatic mat cutting apparatus as claimed in claim 9 wherein said blade edges are disposed at an angle to the plane of said base so as to produce inwardly and downwardly beveled cuts in the mat.

11. An automatic mat cutting apparatus as claimed in claim 10 wherein said cutter moving means and said blade edge moving means are pneumatically driven.

12. An automatic mat cutting apparatus as claimed in claim 1 wherein each said cutter mounting means includes a runner, a slide adapted to move freely along said runner, and an attaching means for attaching a respective said mat cutter to said slide in one of two positions, the first position being slightly inward toward the center of the mat from the second position whereby two mats having openings differing in size by only a slight amount are easily cut by cutting an opening in the first mat with said attaching means in the first position and by cutting an opening in the second mat with said attaching means in the second position.

13. An automatic mat cutting apparatus as claimed in claim 3 wherein said X1, X2, Y1, and Y2 mat cutters include respective X1, X2, Y1, and Y2 cutting blade edges; further including X1, X2, Y1, and Y2 blade edge moving means for reciprocally moving respective said X1, X2, Y1, and Y2 blade edges between a down position wherein said blade edges extend down through the mat and an up position wherein said blade edges are located above the mat; and wherein said control means further controls respective said blade edge moving means so as to insert respective said blade edges into the mat prior to movement of respective said mat cutters from starting positions by respective said cutter moving means and to withdraw respective said blade edges after the desired movement of respective said mat cutters and the desired length of cuts are achieved and before respective said mat cutters are returned to the starting position by respective said cutter moving means.

14. An automatic mat cutting apparatus as claimed in claim 10 wherein said blade edges are disposed at an angle to the plane of said base so as to produce inwardly and downwardly beveled cuts in the mat.

15. An automatic mat cutting apparatus as claimed in claim 14 wherein said cutter moving means and said blade edge moving means are pnematically driven.

16. An automatic mat cutting apparatus as claimed in claim 3 wherein each said cutter mounting means includes a runner, a slide adapted to move freely along said runner, and an attaching means for attaching a respective said mat cutter to said slide in one of two positions, the first position being slightly inward toward the center of the mat from the second position whereby two mats having openings differing in size by only a slight amount are easily cut by cutting an opening in the first mat with said attaching means in the first position and by cutting an opening in the second mat with said attaching means in the second position.

* * * * *